US010242776B2

(12) United States Patent
Morita et al.

(10) Patent No.: US 10,242,776 B2
(45) Date of Patent: Mar. 26, 2019

(54) RECTANGULAR CHIP RESISTOR AND MANUFACTURING METHOD FOR SAME

(71) Applicant: KAMAYA ELECTRIC CO., LTD., Yamato-shi, Kanagawa (JP)

(72) Inventors: Tomiharu Morita, Naie-cho (JP); Yuusuke Nojiri, Naie-cho (JP)

(73) Assignee: Kamaya Electric Co., Ltd., Yamato-shi (JP)

( * ) Notice: Subject to any disclaimer, the term of this patent is extended or adjusted under 35 U.S.C. 154(b) by 0 days.

(21) Appl. No.: 15/568,865

(22) PCT Filed: Apr. 22, 2016

(86) PCT No.: PCT/JP2016/062724

§ 371 (c)(1),
(2) Date: Oct. 24, 2017

(87) PCT Pub. No.: WO2016/171244

PCT Pub. Date: Oct. 27, 2016

(65) Prior Publication Data

US 2018/0108462 A1 Apr. 19, 2018

(30) Foreign Application Priority Data

Apr. 24, 2015 (JP) ..... 2015-089466

(51) Int. Cl.

| | |
|---|---|
| ***H01C 13/02*** | (2006.01) |
| ***H01C 1/142*** | (2006.01) |
| ***H01C 17/065*** | (2006.01) |
| ***H01C 17/242*** | (2006.01) |

(Continued)

(52) U.S. Cl.

CPC ..... *H01C 13/02* (2013.01); *H01C 1/142* (2013.01); *H01C 7/003* (2013.01); *H01C 17/006* (2013.01);

(Continued)

(58) Field of Classification Search

CPC ..... H01C 13/02; H01C 17/06; H01C 17/006; H01C 17/242

(Continued)

(56) References Cited

U.S. PATENT DOCUMENTS 5,548,269 A * 8/1996 Katsuno ..... H01C 1/148 338/195
6,084,502 A * 7/2000 Ariga ..... H01C 17/06 338/195

(Continued)

FOREIGN PATENT DOCUMENTS

JP 84801/1984 U 6/1984
JP S60-28209 A 2/1985

(Continued)

OTHER PUBLICATIONS

Ohno, JP 62-044401, Mar. 1987. Machine translation.*

*Primary Examiner* — Kyung S Lee
(74) *Attorney, Agent, or Firm* — Jason D. Voight

(57) ABSTRACT

The chip resistor includes insulating substrate 10, first and second top electrodes (11*x*, 11*b*) on the top surface of the insulating substrate each on either longitudinal end thereof, and resistive element 12 electrically in contact with the top electrodes, wherein each of the top electrodes has, on its inner side facing to the other, cutout part 11*a* and protruding part 11*b*, with the cutout part in the first top electrode extending from at least one longitudinal side of the insulating substrate, transversely inwards thereof, and with the cutout part in the second top electrode arranged substantially point-symmetrically to the cutout part in the first top electrode with respect to the center of the insulating substrate, wherein the resistive element has contacting regions 12*b*, and non-contacting regions 12*c*, and trimming slot (53*a*, 53*b*) including a linear part.

8 Claims, 6 Drawing Sheets

(51) Int. Cl.
*H01C 17/00* (2006.01)
*H01C 17/06* (2006.01)
*H01C 7/00* (2006.01)

(52) U.S. Cl.
CPC ..... *H01C 17/06* (2013.01); *H01C 17/065* (2013.01); *H01C 17/242* (2013.01)

(58) Field of Classification Search
USPC ..... 338/22 R, 195
See application file for complete search history.

(56) References Cited

U.S. PATENT DOCUMENTS

| | | | | |
|---|---|---|---|---|
| 6,107,909 | A * | 8/2000 | Kosinski | H01C 17/24 29/610.1 |
| 7,782,174 | B2 * | 8/2010 | Urano | H01C 1/012 338/307 |
| 7,940,158 | B2 * | 5/2011 | Yoneda | H01C 1/012 338/307 |
| 2005/0275503 | A1 * | 12/2005 | Yoneda | H01C 1/14 338/309 |

FOREIGN PATENT DOCUMENTS

| | | | |
|---|---|---|---|
| JP | 44401/1987 | U | 3/1987 |
| JP | H04-97501 | A | 3/1992 |
| JP | H05-243002 | A | 9/1993 |
| JP | H10-189317 | A | 7/1998 |
| JP | 2001-203101 | A | 7/2001 |
| JP | 2008-305985 | A | 12/2008 |
| JP | 2009-141171 | A | 6/2009 |

* cited by examiner (a)

(b)

(a)

(b)

RECTANGULAR CHIP RESISTOR AND MANUFACTURING METHOD FOR SAME

This is the national stage of International Application PCT/JP2016/062724, filed Apr. 22, 2016.

FIELD OF ART

The present invention relates to a rectangular chip resistor and a method for producing the same, in which current constriction caused by trimming slots that have been formed for adjustment of resistance, is suppressed, and which has excellent tolerance to overload, such as surge current.

BACKGROUND ART

For adjusting resistance of a chip resistor, there is widely known to form trimming slots in its resistive element. There are conventionally known, for example as shown in FIGS. 9(A) and 9(B), trimming slots 93*a* formed as linear cuts at generally right angles to the direction of the current flowing through a resistive element 92 from a pair of top electrodes 91 disposed on the top surface of an insulating substrate 90 on both ends, and a trimming slot 93*b* formed as an L-shaped cut. Disadvantageously, the flow of the current 94 is turbulent at the tip or at the L-shaped bend of these trimming slots to cause local heat generation due to current constriction or change in resistance due to development of microcracks.

In view of the above, there have been proposed various techniques for controlling the problems caused by such current constriction (see Patent Publications 1 to 4).

These prior art trimming slots, however, are formed linearly or in L-shape by first cutting out the slots at generally right angles to the direction of the current flowing through the resistive element, so that it is difficult to sufficiently suppress the current turbulence caused by the trimming slots.

Patent Publication 5 proposes to form a trimming slot by linearly cutting the resistive element in its longitudinal direction over its full length in parallel to the direction of the current flowing through the resistive element. According to this method, the trimming slot is required to be formed even into the electrodes adjacent to the resistive element, in order to inhibit microcracks which tend to form at the tip of the trimming slots. In this case, since the resistive element is not reliably cut out from the electrodes due to the trimming slot, it is difficult to precisely set the resistance during the formation of the trimming slots. In addition, the resistive element is completely divided by the trimming slot in the current-carrying condition, so that the smaller region of the divided resistive element may have risk of current load constriction.

PRIOR ART PUBLICATIONS

Patent Publication 1: JP-H04-97501-A
Patent Publication 2: JP-H10-189317-A
Patent Publication 3: JP-2001-203101-A
Patent Publication 4: JP-2009-141171-A
Patent Publication 5: JP-S60-28209-A

SUMMARY OF THE INVENTION

Problems to be Solved by the Invention

It is an object of the present invention to provide a rectangular chip resistor in which current constriction caused by trimming slots is suppressed, and which has excellent tolerance to overload, such as surge current.

It is another object of the present invention to provide a method for producing a rectangular chip resistor, which allows excellently precise, and wide range of resistance setting, as well as easy and fine adjustment of resistance, resulting in efficient manufacturing of rectangular chip resistors in which current constriction caused by trimming slots is effectively suppressed and which have excellent tolerance to current overload.

It is another object of the present invention to provide a rectangular chip resistor and a method for producing the same, which allows sufficient suppression of adverse effects of current constriction due to microcracks generated during trimming of the resistive element, and current overload.

Means for Solving the Problems

According to the present invention, there is provided a rectangular chip resistor comprising:

an insulating substrate, a pair of first and second top electrodes disposed on a top surface of the insulating substrate each on either longitudinal end thereof, and a resistive element electrically in contact with said top electrodes, wherein each of said first and second top electrodes has, on its inner side facing to the other, a cutout part and a protruding part protruding with respect to the cutout part, with said cutout part in the first top electrode extending from at least one of two longitudinal sides of the insulating substrate, transversely inwards of the insulating substrate, and with said cutout part in the second top electrode being arranged substantially point-symmetrically to said cutout part in the first top electrode with respect to a center of the insulating substrate, wherein said resistive element has contacting regions each in contact with said first or second top electrode along the protruding part, and non-contacting regions each out of contact with said top electrodes along the cutout part, and wherein said resistive element has a trimming slot including a linear part extending from at least one point on said non-contacting regions along a longitudinal direction of the insulating substrate.

In the resistive element, at least two trimming slots may be formed, comprising a trimming slot including a linear part extending from at least one point on one non-contacting region on the side of the first top electrode along a longitudinal direction of the insulating substrate, and a trimming slot including a linear part extending from at least one point on one non-contacting region on the side of the second top electrode along a longitudinal direction of the insulating substrate. With two or more, i.e., a plurality of, trimming slots, the length of each trimming cut may be made shorter, which allows further reduction of current constriction and easy and fine adjustment of the resistance.

At least one of the trimming slots may be, for example, in an L-shape having said linear part extending along a longitudinal direction of the insulating substrate, and a subsequent bend extending from a tip of said linear part, transversely outwards of the insulating substrate. By allowing formation of trimming slots of such a shape, the resistance setting may be controlled over a wider range.

Each protruding part of the first and second top electrodes may be in the shape with two vertices, whereas the resistive element has contacting points in contact with these vertices. The resistive element may be divided into two virtual areas;

a rectangular area enclosed by straight lines connecting these contacting points, and an area other than the rectangular area. The area other than the rectangular area, which is out of contact with the first and second top electrodes, may be a trimming-slot-forming area. By defining such a trimming-slot-forming area, trimming slots for setting the resistance may be formed still more easily and conveniently without causing turbulence of current in the rectangular area. Further, by adjusting the angle of one of the two opposite pairs of angles, sufficient flow of current may be secured in the rectangular area, the defect of current constriction at the trimming slots may sufficiently be alleviated, the resistance change ratio may be kept low against overload voltage even when the rated power of the resistor is high, and the limiting power may be increased.

According to the present invention, there is provided a method for producing a rectangular chip resistor, comprising:

(A) providing a pair of first and second top electrodes on a top surface of an insulating substrate each on either longitudinal end thereof, (B) providing a resistive element in electrical contact with said first and second top electrodes, and (C) forming a trimming slot in the resistive element for adjusting resistance, wherein in said step (A), said first top electrode is formed so as to have, on its inner side facing to said second top electrode, a cutout part extending from at least one of two longitudinal sides of the insulating substrate, transversely inwards of the insulating substrate, and a protruding part protruding with respect to the cutout part, and said second top electrode is formed so as to have, on its inner side facing to said first top electrode, a cutout part arranged substantially point-symmetrically to said cutout part in the first top electrode with respect to a center of the insulating substrate, and a protruding part protruding with respect to the cutout part, wherein in said step (B), said resistive element is provided in a shape having contacting regions each in contact with said first or second top electrode along the protruding part, and at least one non-contacting region for each top electrode out of contact therewith along the cutout part, and wherein in said step (C), said trimming slot is formed to include a linear part extending from at least one point on the non-contacting regions of the resistive element along a longitudinal direction of the insulating substrate, by laser trimming from said at least one point.

In step (C), at least one trimming slot may be formed by laser trimming from said at least one point on the non-contacting regions along a longitudinal direction of the insulating substrate, and then by laser trimming in a direction bent transversely outwards of the insulating substrate. By forming a trimming slot along a longitudinal direction of the insulating substrate in this way, for example, generation of noise caused by microcracks formed at the bent portion or the like may be suppressed, and the change in resistance may be suppressed.

Further, a higher ratio of microcracks is oriented toward the longitudinal direction of the insulating substrate, so that the current constriction due to the generated microcracks and the effect of current overload may sufficiently be suppressed.

In step (C), in forming a plurality of trimming slots extending from a plurality of points on said non-contacting regions of the resistive element along the longitudinal direction of the insulating substrate, the trimming slots may be formed by laser trimming so as to partly overlap one on another along a trimming direction. By laser trimming in this way, trimming may be carried out while removing the cutting scrap from the resistive element generated in the previous trimming.

EFFECT OF THE INVENTION

The rectangular chip resistor according to the present invention (sometimes referred to as the present resistor hereinbelow) has the above-mentioned configuration wherein, in particular, the region where the first and second top electrodes are in contact with the resistive element and the region where the electrode are out of contact therewith, are distinctly divided, and the resistive element has a trimming slot including a linear part extending along the longitudinal direction, and formed from at least one point on the non-contacting regions of the resistive element. Thus, sufficient area in the resistive element may be secured for the current flowing unaffected by the trimming slots, and even in the area having the trimming slots formed therein, the current constriction may be suppressed by bringing the direction of the trimming slots into general conformity with the current flow direction. Further, the length of the contacting regions of the resistive element in contact with the first or second top electrode, and the length of the non-contacting regions out of contact therewith, may suitably be controlled, and the length and the number of the trimming slots may be controlled, so that a wide range of desired resistance may be secured. Thus, with the above-mentioned configuration, the problem of current constriction due to trimming slots may be solved easier compared to the prior art, the tolerance to the overload current may be improved, the change in resistance may be suppressed sufficiently even at a higher rated power of the resistor, and the limiting power may be increased.

The production method according to the present invention has the above-mentioned configuration wherein, in particular, the cutout parts and the protruding parts are formed in step (A), and the contacting regions and the non-contacting regions are provided on the resistive element distinctly dividedly in step (B). Thus, sufficient area may be secured for the current flowing unaffected by the trimming slots, and the area in which the trimming slots are to be formed may be distinctly defined. In this way, precise control of the resistance setting is facilitated, the range of the resistance adjustment is widened, and the fine adjustment of the resistance is easily achieved. Further, the microcracks, which may be generated in the trimming in step (C), tend to be oriented toward the longitudinal direction of the insulating substrate, so that the current constriction due to the generated microcracks and the effect of current overload may sufficiently be suppressed.

EMBODIMENTS OF THE INVENTION

Embodiments of the present invention will now be explained with reference to the attached drawings, which do not limit the present invention.

Figure 1:
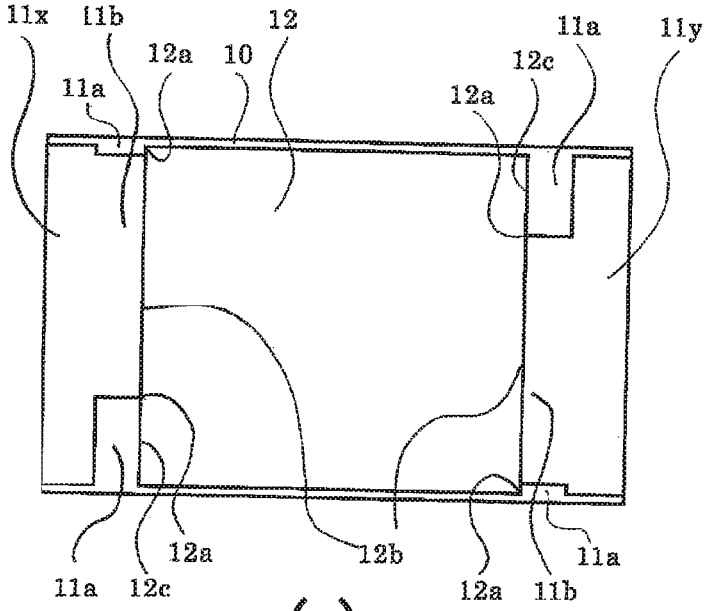
FIGS. 1(*a*) and 1(*b*) are plan views of embodiments of the resistor of the present invention, illustrating the relationship between the first and second top electrodes and the resistive element.
Figure 1:
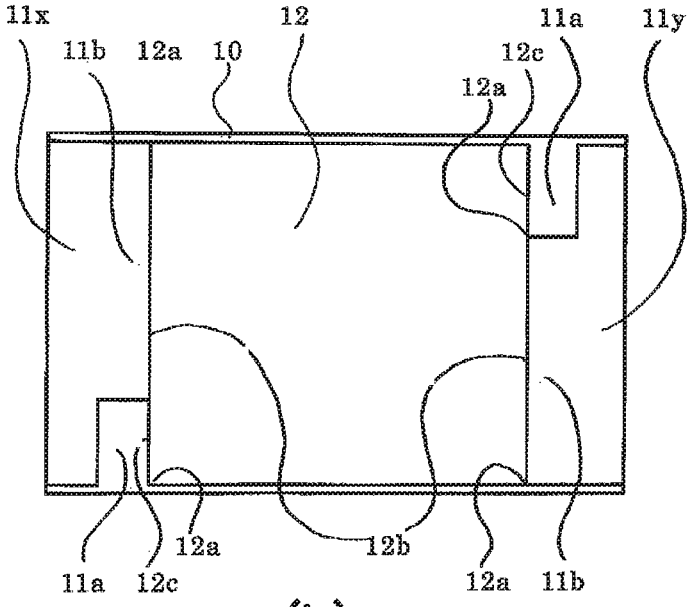
Figure 2:
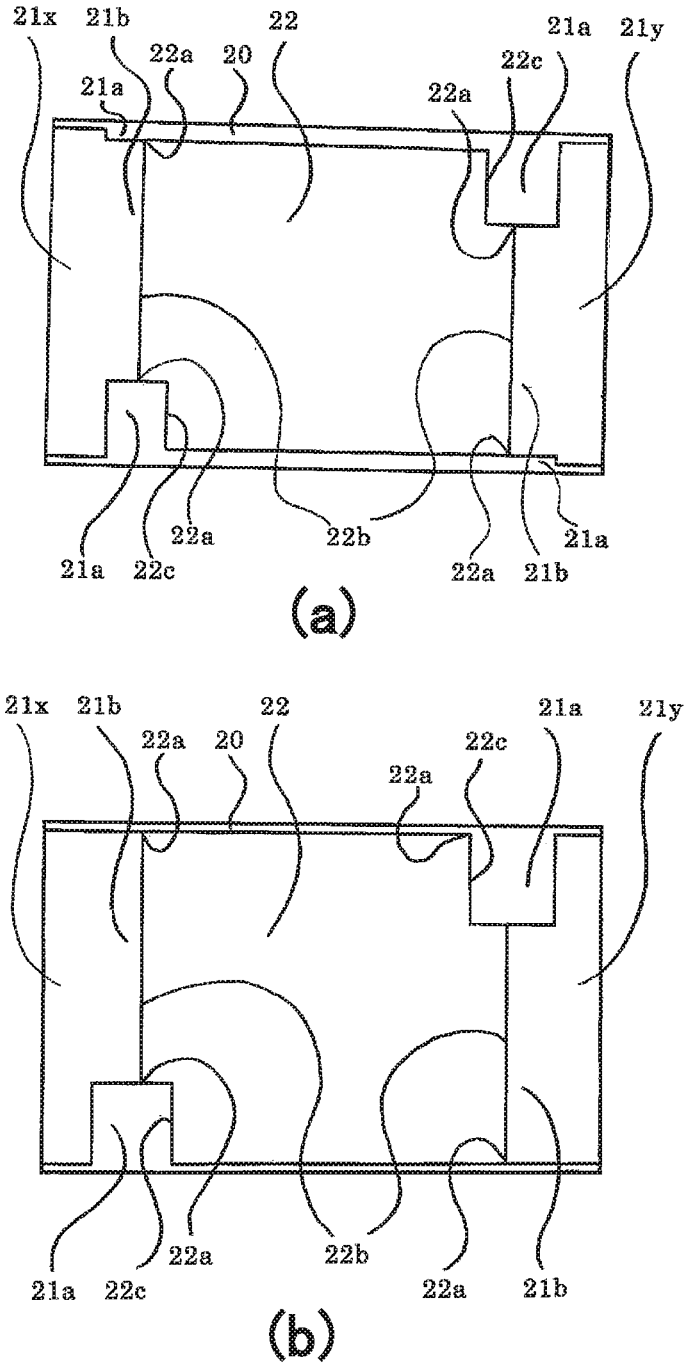
FIGS. 2(*a*) and 2 (*b*) are plan view of another embodiments of the resistor of the present invention, illustrating the relationship between the first and second top electrodes and the resistive element.
Figure 3:
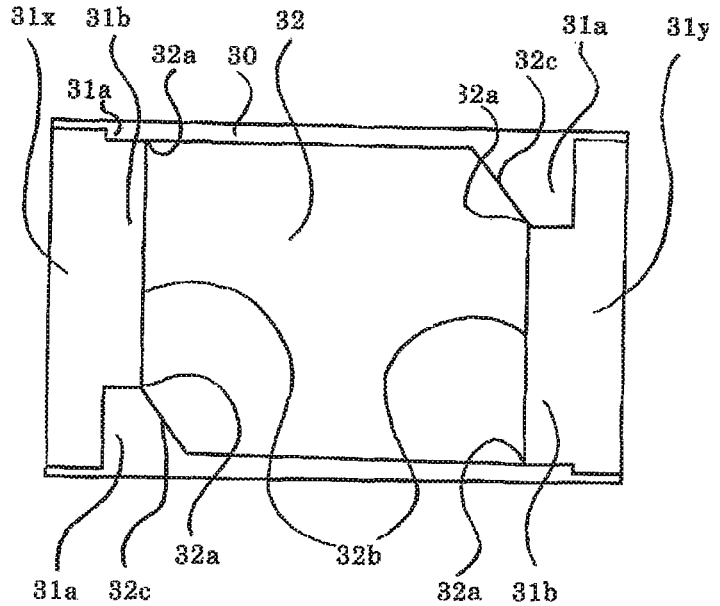
FIGS. 3(*a*) and 3(*b*) are plan views of yet another embodiments of the resistor of the present invention, illustrating the relationship between the first and second top electrodes and the resistive element.
Figure 3:
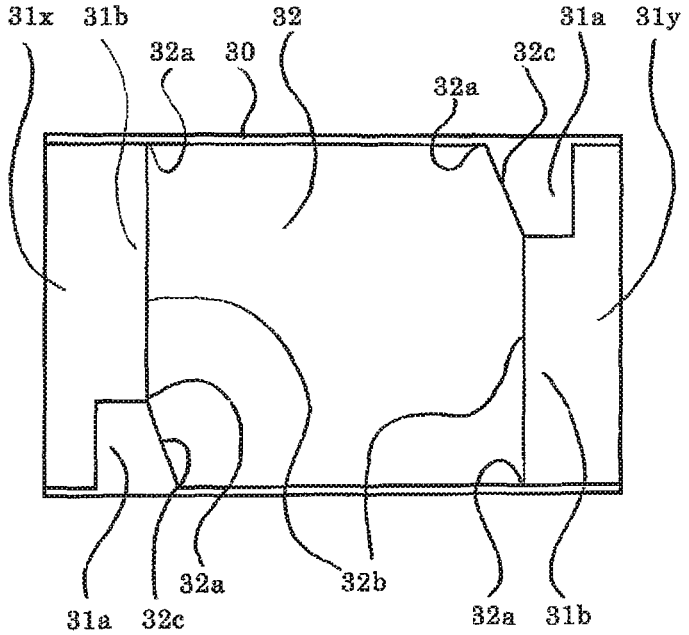

FIGS. 1(*a*) and 1(*b*), FIGS. 2(*a*) and 2(*b*), and FIGS. 3(*a*) and 3 (*b*) are plan views of various examples of a resistor according to the pre sent invention before the trimming slots are formed, illustrating the shapes of and the relationship between the first and second top electrodes and the resistive element.

Referring to FIGS. 1(*a*) and 1(*b*), 2(*a*) and 2(*b*) and 3(*a*) and 3(*b*), the reference numerals 10, 20, and 30 each refers to an insulating substrate, which is provided with a pair of first top electrode (11*x*, 21*x*, 31*x*) and second top electrode (11*y*, 21*y*, 31*y*) formed by screen printing on the top surface each on either longitudinal end of the substrate, and a resistive element (12, 22, 32) formed by screen printing in electrical contact with the top electrodes.

Referring to FIGS. 1(*a*), 2(*a*), and 3(*a*), the first top electrode (11*x*, 21*x*, 31*x*) has two cutout parts (11*a*, 21*a*, 31*a*) each extending from either of the two longitudinal sides of the insulating substrate (10, 20, 30), transversely inwards of the substrate, and one protruding part (11*b*, 21*b*, 31*b*) protruding with respect to these cutout parts. On the other hand, the second top electrode (11*y*, 21*y*, 31*y*) has, facing to the first top electrode as shown in the figures, cutout parts (11*a*, 21*a*, 31*a*) and a protruding part (11*b*, 21*b*, 31*b*) arranged substantially point-symmetrically to the cutout parts (11*a*, 21*a*, 31*a*) and the protruding part (11*b*, 21*b*, 31*b*) in the first top electrode with respect to the center of the insulating substrate. That is, in FIGS. 1(*a*), 2(*a*), and 3(*a*), the first and second top electrodes each has two cutout parts and one protruding part, and are generally in the same shape and arranged substantially point-symmetrically.

As used herein, "substantially point-symmetrically" means that not only the embodiments wherein the shapes of the first and second top electrodes are totally identical is encompassed, but also the embodiments wherein the shapes are generally the same is encompassed. For example, when the first and second top electrodes are formed by printing or the like means, even when the two electrodes are printed in the same shape in design, it is sometimes difficult to completely conform the shapes of the two electrodes due to some deformation. Further, it does not mean that the solution to the problem to be solved by the present invention is not achieved unless the first and second top electrodes are perfectly in the identical shape. Thus, the term "substantially point-symmetrically" means as discussed above, and the difference in shape between the first and second top electrodes may be tolerated as long as the problems to be solved by the present invention are solved.

Referring to FIGS. 1(*b*), 2(*b*), and 3(*b*), the first top electrode (11*x*, 21*x*, 31*x*) has one cutout part (11*a*, 21*a*, 31*a*) extending from one of the two longitudinal sides of the insulating substrate (10, 20, 30), transversely inwards of the substrate, and a protruding part (11*b*, 21*b*, 31*b*) protruding with respect to the cutout part. On the other hand, the second top electrode (11*y*, 21*y*, 31*y*) has, facing to the first top electrode as shown in the figures, a cutout part (11*a*, 21*a*, 31*a*) and a protruding part (11*b*, 21*b*, 31*b*) arranged substantially point-symmetrically to the cutout part (11*a*, 21*a*, 31*a*) and the protruding part (11*b*, 21*b*, 31*b*) in the first top electrode with respect to the center of the insulating substrate. That is, in FIGS. 1 (*b*), 2 (*b*), and 3(*b*), the first and second top electrodes each has one cutout part and one protruding part, and are generally in the same shape and arranged substantially point-symmetrically.

Referring to FIGS. 1(*a*) and 1 (*b*), the resistive element 12 is in a rectangle shape, and in electrical contact with the first and second top electrodes along two contacting regions 12*b* each containing two contacting points 12*a* of the resistive element 12, which points are in contact with the two vertices of the protruding part 11*b* of the first or second top electrode.

Each of the two cutout parts 11*a* of each of the first and second top electrodes (11*x*, 11*y*) in FIG. 1(*a*), and the one cutout part 11*a* of each of the first and second top electrodes (11*x*, 11*y*) in FIG. 1(*b*), forms a space to keep the first and second top electrodes (11*x*, 11*y*) out of contact with the resistive element 12. By such a cutout part 11*a* forming the space, the resistive element 12 is provided with non-contacting region 12*c*, which is out of contact with the first and second top electrodes (11*x*, 11*y*).

Referring to FIGS. 2(*a*) and 2 (*b*), the resistive element 22 is, as shown in the figures, in an octagonal shape, having six 90° convex interior angles and two 270° concave interior angles, and in electrical contact with the first and second top electrodes along two contacting regions 22*b* each containing two contacting points 22*a* of the resistive element 22, which points are in contact with the two vertices of the protruding part 21*b* of the first or second top electrode.

Each of the two cutout parts 21*a* of each of the first and second top electrodes (21*x*, 21*y*) in FIG. 2(*a*), the one cutout part 21*a* of each of the first and second top electrodes (21*x*, 21*y*) in FIG. 2(*b*), and cutout-like parts of the octagonal resistive element 22 external to the concave interior angles, forms a space to keep the first and second top electrodes (21*x*, 21*y*) out of contact with the resistive element 22, as shown in the figures. By such a cutout part 21*a* and the like forming the space, the resistive element 22 is provided with non-contacting region 22*c*, which is out of contact with the first and second top electrodes (21*x*, 21*y*).

Referring to FIGS. 3 (*a*) and 3 (*b*), the resistive element 32 is, as shown in the figures, in a hexagonal shape, having two 90° interior angles and four 135° interior angles, and in electrical contact with the first and second top electrodes along two contacting regions 32*b* each containing two contacting points 32*a* of the resistive element 32, which points are in contact with the two vertices of the protruding part 31*b* of the first or second top electrode.

Each of the two cutout parts 31*a* of each of the first and second top electrodes (31*x*, 31*y*) in FIG. 3 (*a*), the one cutout part 31*a* of each of the first and second top electrodes (31*x*, 31*y*) in FIG. 3(*b*), and cutout-like parts of the hexagonal resistive element 32 respectively external to the four 135° interior angles, forms a space to keep the first and second top electrodes (31$x$, 31$y$) out of contact with the resistive element 32, as shown in the figures. By such a cutout part 31$a$ and the like forming the space, the resistive element 32 is provided with non-contacting region 32$c$, which is out of contact with the first and second top electrodes (31$x$, 31$y$).

Figure 4:
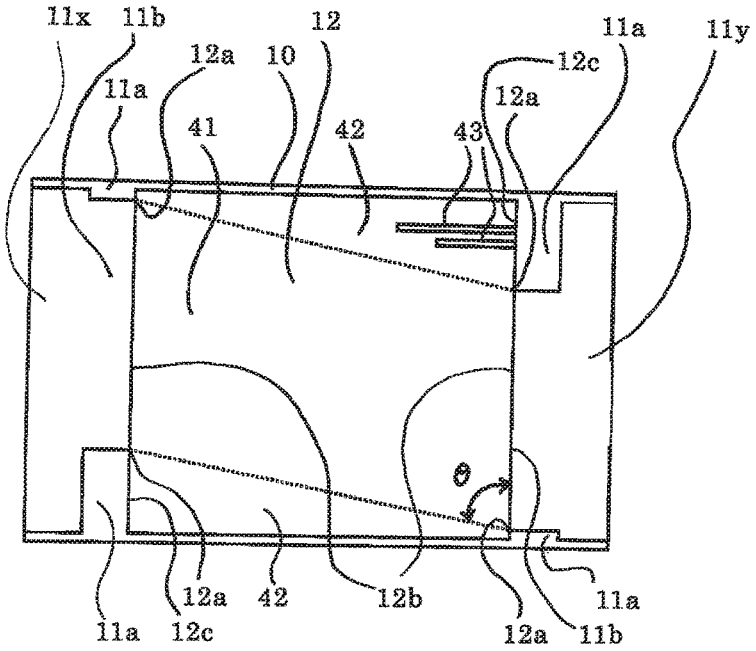
FIG. 4 is a plan view of an embodiment of the resistor of the present invention, illustrating the shapes and the positions of the trimming slots.
Figure 5:
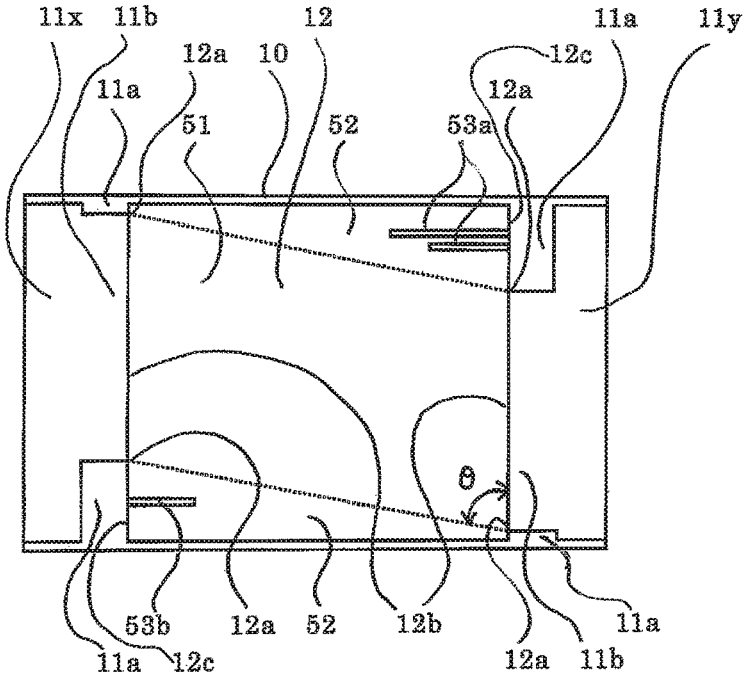
FIG. 5 is a plan view of another embodiment of the resistor of the present invention, illustrating the shapes and the positions of the trimming slots.
Figure 6:
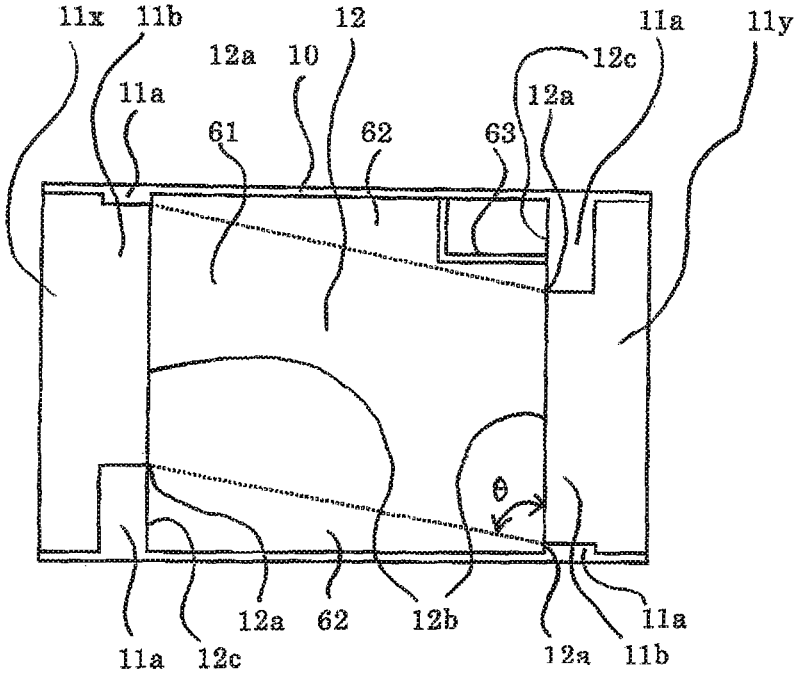
FIG. 6 is a plan view of yet another embodiment of the resistor of the present invention, illustrating the shapes and the positions of the trimming slots.

FIGS. 4 to 6 are plan views, illustrating examples of the shapes and positions of the trimming slots formed in the resistor of the present invention having the first and second top electrodes (11$x$, 11$y$) and the resistive element 12, discussed above with reference to FIG. 1($a$), wherein the elements identical with those shown in FIG. 1($a$) are referred to by the same reference numerals, and their descriptions are omitted. Further, FIGS. 7($a$) and 7($b$) are schematic views, illustrating how the trimming slots are formed in the resistor of the present invention.

Referring to FIGS. 4 to 6, the resistive element 12 is composed of a rectangular area enclosed by straight lines connecting four contacting points 12$a$, i.e., a virtual parallelogram area (41, 51, 61) enclosed by the two contacting regions 12$b$ forming the two sides, and the two dotted lines shown in the figures, and the areas other than the parallelogram area out of contact with the first and second top electrodes (11$x$, 11$y$), i.e., two trimming-slot-formed areas (42, 52, 62), which are the resistive element areas external to the dotted lines in the figures.

The parallelogram area (41, 51, 61) is preferably an area in which the trimming slots are not formed, so that the flow of the current from the first and second top electrodes (11$x$, 11$y$) is not disturbed. Thus, by securing such an area extensively, the desired objects of the present invention are more easily achieved. In view of this, angle θ indicated in the figures is preferably 70° to 90°, more preferably 75° to 90°, most preferably 80° to 90°. By securing such an area (41, 51, 61) more extensively and employing the configuration to form the trimming slots in the particular direction in the trimming-slot-formed areas (42, 52, 62), the defects of current constriction at the trimming slots may be alleviated more sufficiently, the change in resistance may be kept still lower against overload voltage even when the rated power of the resistor is high, and the limiting power may be increased still more.

FIG. 4 is a plan view of an embodiment of the resistor according to the present invention, wherein the trimming slots 43 are formed in only one of two trimming-slot-formed areas 42. Referring to FIG. 4, the trimming slots 43 are formed in two linear shapes of different lengths extending from two points on a non-contacting region 12$c$ along the longitudinal direction of the insulating substrate 10. The number, length, width, and the like of the trimming slots may suitably be decided, taking the desired resistance, rated power, and the like factors into consideration. The trimming slots may be formed by a conventional manner, for example, laser cutting while the resistance is measured with probes in contact with the resistive element.

In the present resistor, for example as shown in FIG. 4, the trimming slots 43 start from the non-contacting region 12$c$, which is out of contact with the second top electrode 11$y$, and are formed in linear shape extending from the starting end, along the longitudinal direction of the insulating substrate 10, i.e., along the direction of the current flowing through the resistive element 12. Thus, the current constriction at the trimming slots 43 may be suppressed sufficiently.

FIG. 5 is a plan view of an embodiment of the resistor according to the present invention, wherein the trimming slots (53$a$, 53$b$) are formed in each of the two trimming-slot-formed areas 52. Referring to FIG. 5, the trimming slots (53$a$, 53$b$) are formed in linear shapes extending from two points and one point on respective non-contacting regions 12$c$ along the longitudinal direction of the insulating substrate 10. With the trimming slots formed in each of the two trimming-slot-formed areas, the resistance may be set over a wider range. Further, since the range of adjustment of the length and width of one trimming slot is also extended, the current constriction may be suppressed still more easily.

FIG. 6 is a plan view of an embodiment of the resistor according to the present invention, wherein the trimming slot 63 is formed in only one of two trimming-slot-formed areas 62. Referring to FIG. 6, the trimming slot 63 is formed in an L-shape cut out from one point on the non-contacting region 12$c$ along the longitudinal direction of the insulating substrate 10 and then in the direction bent transversely outwards of the insulating substrate 10 at right angles. When a trimming slot is formed in such an L-shape, usually microcracks are likely to form at the bent portion. However, according to the present invention, as discussed above, the trimming slot 63 is formed first by linear cut from one point on the non-contacting region 12$c$ along the longitudinal direction of the insulating substrate 10, i.e., linear cut in the direction of the current flow, so that the microcracks are likely to form in the direction of the current flow, which facilitates suppression of defects and noise caused by current constriction due to the generated microcracks.

Figure 7:
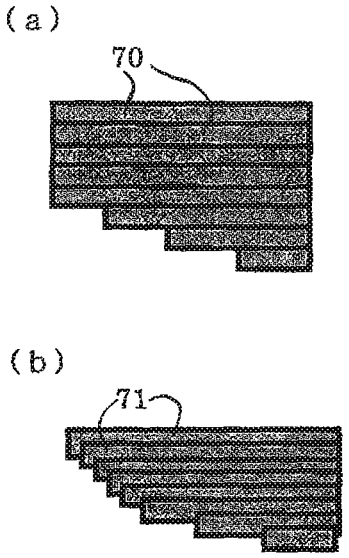
FIGS. 7(*a*) and 7(*b*) are schematic views, illustrating two examples of how to form the trimming slots in the resistor of the present invention.

FIGS. 7($a$) and 7($b$) are schematic views, illustrating how the trimming slots are formed in the present resistor. FIG. 7($a$) shows an example wherein trimming slots 70 of the same width are formed in the same length to different lengths so that the adjacent slots are contiguous to each other. With a plurality of trimming slots of the same width, fine adjustment of the resistance is facilitated.

FIG. 7($b$) shows an example wherein trimming slots 71 of the same width are formed in the same length to different lengths so that the adjacent slots are partly overlapped. With a plurality of trimming slots of the same width, fine adjustment of the resistance is facilitated. Further, by forming a trimming slot so as to partly overlap the previously formed trimming slot, trimming may be carried out while removing the cutting scrap from the resistive element generated in the previous trimming.

According to the present resistor, the shape of the trimming slots may be selected from various shapes, as long as the shape includes a linear part extending along the longitudinal direction of the insulating substrate, and the number, length, width, and the like of the trimming slots may suitably be selected so as to form the slots in the above-mentioned predetermined locations for achieving the desired resistance.

An embodiment for illustrating the configuration of the present resistor and an embodiment of the production method of the present invention will now be explained with reference to the drawings, but the method of producing the present invention is not limited to the production method of the present invention.

Figure 8:
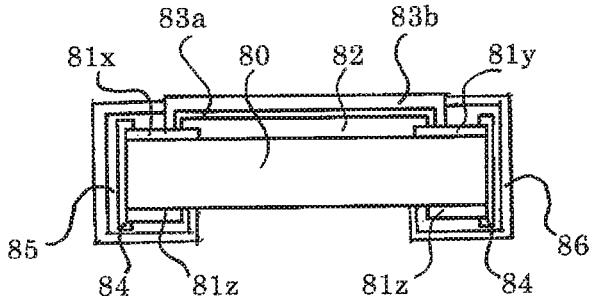
FIG. 8 is a sectional view, illustrating the configuration of an embodiment of the resistor of the present invention.

FIG. 8 is a sectional view illustrating the configuration of an embodiment of the present resistor, wherein reference numeral 80 refers to an insulating substrate. On the top surface of the insulating substrate 80 are provided a pair of first and second top electrodes 81$x$ and 81$y$ each on either end, and a resistive element 82 in electrical contact with the first and second top electrodes. The relationship between the top electrodes and the resistive element is as discussed above with reference to FIGS. 1 to 3.

On the under surface of the insulating substrate 80 are provided a pair of bottom electrodes 81$z$. The resistive element 82 is protected with a glass-type protective film 83$a$ and a resin-type protective film 83$b$, as shown in the figure.

Though not shown, the resistive element 82 is provided with trimming slots, as discussed with reference to FIGS. 4 to 7.

The first and second top electrodes (81*x*, 81*y*) and the bottom electrodes 81*z* are connected with end electrodes 84. The top, bottom, and end electrodes are coated with a nickel plated layer 85, which is coated with a tin plated layer 86 as overcoating.

The configuration illustrated in FIG. 8 is merely an example, and the resistor of the present invention is not limited to this. The materials of the constituting elements may suitably be selected from known materials or the like.

The production method according to the present invention includes: (A) providing a pair of first and second top electrodes on the top surface of an insulating substrate each on either longitudinal end thereof, (B) providing a resistive element in electrical contact with the first and second top electrodes, and (C) forming a trimming slot in the resistive element for adjusting resistance. In the following, each step is explained with reference to an example wherein the cutout parts and the like are formed by screen printing, but formation by other means, such as laser patterning or etching, are also encompassed by the present invention.

In steps (A) and (B), the top electrodes and the resistive element may be formed on the insulating substrate by, usually, screen printing or the like means, so as to be in the desired shapes as discussed above.

In step (A), the first top electrode is formed so as to have, on its inner side facing to the second top electrode, a cutout part extending from at least one of the two longitudinal sides of the insulating substrate, transversely inwards of the insulating substrate, and a protruding part protruding with respect to the cutout part, whereas the second top electrode is formed so as to have, on its inner side facing to the first top electrode, a cutout part arranged substantially point-symmetrically to the cutout part in the first top electrode with respect to the center of the insulating substrate, and a protruding part protruding with respect to the cutout part. Here, the cutout parts have been explained to be formed by screen printing, but may alternatively be formed by laser patterning or etching, after the top electrodes are formed.

In step (B), the resistive element is provided in a shape having contacting regions each in contact with the first or second top electrode along the protruding part, and at least one non-contacting region for each top electrode out of contact therewith along the cutout part.

The desired shapes of the top electrodes and the resistive element formed in this way are as discussed above with reference to FIGS. 1 to 3.

In step (C), the trimming slot may be formed by a conventional manner, for example, laser cutting while the resistance is measured with probes in contact with the resistive element, as discussed above.

In step (C), the trimming slot is formed to include a linear part extending from at least one point on the non-contacting regions of the resistive element along the longitudinal direction of the insulating substrate, by laser trimming from the at least one point, as discussed above with reference to FIGS. 4 to 6.

According to the production method of the present invention, the present resistor may be produced by performing, in addition to steps (A) to (C), steps of, for example, forming bottom and end electrodes, protective films, and plated layers by conventional manners or the like, as discussed above with reference to FIG. 8.

EXAMPLES

The present invention will now be explained in further detail with reference to examples, which however, do not limit the present invention.

Examples 1-1 to 1-3

Resistors as shown in FIG. 8 were produced using the first and second top electrodes and the resistive element having the trimming slots, as shown in FIG. 5, to have the rated power of 0.1 W, 0.25 W, 0.33 W, and 0.4 W, respectively. The insulating substrate was composed of a 96% alumina substrate; the top electrodes of silver-palladium-containing metal films; the bottom electrodes of silver-containing metal films; the resistive element of a resistive film using a ruthenium-oxide-containing special resistant material; the end electrodes of nickel-chromium-containing metal films formed by sputtering, the protective film 83*a* of a glass-type film; the protective film 83*b* of a silver-palladium-containing film; the plated layer 85 of a nickel plated layer; and the plated layer 86 of a tin plated layer, respectively.

In Example 1-1 the angle θ in FIG. 5 was 70°, in Example 1-2 the angle θ was 79°, and in Example 1-3 the angle θ was 87°.

The short time overload test was conducted on each resistor thus produced, by applying a voltage 2.5 times the rated voltage for 5 seconds, i.e., 14.14V on the resistor with the rated power of 0.1 W, 22.36 V on the resistor with the rated power of 0.25 W, 25.69 V on the resistor with the rated power of 0.33 W, and 28.28 V on the resistor with the rated power of 0.4 W, respectively, and measuring the maximum, minimum, and mean values of the resistance change ratio (ΔR/R). The results are shown in Table 1. The resistors exhibiting the resistance change ratio of within ±1.0% passed the test. Incidentally, the blanks in Table 1 mean incapable of measurement.

Comparative Example 1

Figure 9:
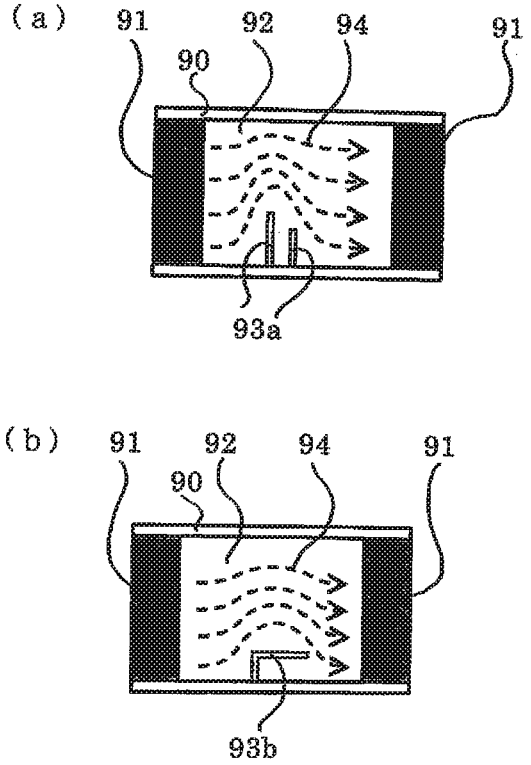
FIGS. 9(*a*) and 9(*b*) are plan views of chip resistors, illustrating examples of conventional trimming slots formed in chip resistors and the flow of current through the resistors.

A resistor was produced in the same way as in Example 1-1, except that the top electrodes and the resistive element were those shown in FIG. 9(*a*), wherein the two trimming slots formed in the resistive element shown in FIG. 9(*a*) were changed to three trimming slots of different lengths. The short time overload test was conducted on the resistor thus obtained in the same way as in Example 1-1. The results are shown in Tale 1.

TABLE 1

| Rated power (W) | Resistance change ratio ΔR/R (%) | Comp. Ex. 1 — | Ex. 1-1 θ = 70° | Ex. 1-2 θ = 79° | Ex. 1-3 θ = 87° |
|---|---|---|---|---|---|
| 0.1 | Max. | 0.00 | 0.00 | +0.01 | 0.00 |
| | Min. | −0.03 | −0.01 | −0.02 | −0.03 |
| | Mean | −0.01 | 0.00 | −0.01 | −0.01 |
| 0.25 | Max. | +0.22 | +0.27 | −0.09 | −0.01 |
| | Min. | −0.10 | −0.18 | −0.14 | −0.01 |
| | Mean | +0.02 | −0.07 | −0.11 | −0.01 |
| 0.33 | Max. | | +0.47 | +0.33 | −0.03 |
| | Min. | | −0.21 | −0.31 | −0.04 |
| | Mean | | +0.21 | +0.01 | −0.03 |
| 0.4 | Max. | | | +4.51 | −0.05 |
| | Min. | | | +2.34 | −0.07 |
| | Mean | | | +3.63 | −0.06 |

The results shown in Table 1 indicate that the resistors of the present invention are excellent in tolerance to overload voltage even with higher rated powers, compared to the resistor of Comparative Example. It is also shown that this advantage is further improved in the present resistors at larger θ.

Examples 2-1 to 2-3 and Comparative Example 2

Resistors with a rated power of 0.1 W, 0.25 W, and 0.33 W, respectively, were produced in the same way as in Examples 1-1 to 1-3 and Comparative Example 1.

The intermittent overload test was conducted on each resistor thus produced, by performing 10000 cycles of application of a voltage 2.5 times the rated voltage for 1 second and non-application of a voltage for 25 seconds, and measuring the maximum, minimum, and mean values of the resistance change ratio (ΔR/R). The results are shown in Table 2. The resistors exhibiting the resistance change ratio of within ±1.0% passed the test. Incidentally, the blanks in Table 2 mean incapable of measurement.

TABLE 2

| Rated power (W) | Resistance change ratio ΔR/R (%) | Comp. Ex. 2 — | Ex. 2-1 θ = 70° | Ex. 2-2 θ = 79° | Ex. 2-3 θ = 87° |
|---|---|---|---|---|---|
| 0.1 | Max. | +0.04 | +0.03 | +0.05 | 0.00 |
| | Min. | −0.06 | 0.00 | −0.06 | −0.03 |
| | Mean | 0.00 | +0.02 | +0.02 | −0.01 |
| 0.25 | Max. | | | −0.02 | −0.01 |
| | Min. | | | −0.06 | −0.01 |
| | Mean | | | −0.04 | 0.00 |
| 0.33 | Max. | | | +5.50 | +0.20 |
| | Min. | | | +1.30 | −0.03 |
| | Mean | | | +2.50 | +0.03 |

The results shown in Table 2 indicate that the resistors of the present invention are more excellent in tolerance at larger θ even with higher rated powers in the intermittent overload test.

Examples 3-1 to 3-3 and Comparative Example 3

Resistors were produced in the same way as in Examples 1-1 to 1-3 and Comparative Example 1.

The resistors thus produced were measured of the one pulse limiting power (voltage V×application time t=limiting power (W)) by applying voltage V for application time 1 ms. The results are shown in Table 3. The limiting power was taken from those of the resistance change ratio of within ±1.0%.

TABLE 3

| Application time | | Comp. Ex. 3 — | Ex. 3-1 θ = 70° | Ex. 3-2 θ = 79° | Ex. 3-3 θ = 87° |
|---|---|---|---|---|---|
| 1 ms | Limiting power (W) | 6.5 | 6.5 | 18 | 38 |

The results shown in Table 3 indicate that, in the resistors of the present invention, the limiting power may be increased by controlling the angle θ.

Examples 4-1 to 4-3 and Comparative Example 4

Resistors were produced in the same way as in Examples 1-1 to 1-3 and Comparative Example 1.

The current-noise test for fixed resistors was conducted on each resistor thus produced according to JIS C 5201-1 to measure the noise voltage generated by the resistor, and the maximum, minimum, and mean values of the noise voltage were obtained by calculation with predetermined formulae. Further, the noise from the maximum to minimum values was obtained. The results are shown in Table 4. The results are indicated as ratios of the noise voltage with respect to the applied direct-current voltage, and negative values with larger absolute values indicate better results.

TABLE 4

| Resistance change ratio ΔR/R (%) | Comp. Ex. 4 — | Ex. 4-1 θ = 70° | Ex. 4-2 θ = 79° | Ex. 4-3 θ = 87° |
|---|---|---|---|---|
| Max. | −3.8 | −11.3 | −12.9 | −22.0 |
| Min. | −13.2 | −13.5 | −14.8 | −23.4 |
| Mean | −10.0 | −12.6 | −14.0 | −22.9 |
| Max − Min | 9.4 | 2.2 | 1.9 | 1.4 |

The results in Table 4 indicate that the noise voltage is suppressed in the present resistors compared to that of the Comparative Example, and this trend is more significant particularly at larger angle θ.

DESCRIPTION OF REFERENCE NUMERALS

10, 20, 30, 80: insulating substrate
11*x*, 21*x*, 31*x*, 81*x*: first top electrode
11*y*, 21*y*, 31*y*, 81*y*: second top electrode
12, 22, 32, 82: resistive element
11*a*, 21*a*, 31*a*: cutout part
11*b*, 21*b*, 32*b*: protruding part
12*b*, 22*b*, 32*b*: contacting region
12*c*, 22*c*, 32*c*: non-contacting region
43, 53*a*, 53*b*, 63, 70, 71: trimming slot
41, 51, 61: parallelogram area
42, 52, 62: trimming-slot-formed area

What is claimed is:

1. A rectangular chip resistor comprising:

an insulating substrate, a pair of first and second top electrodes disposed on a top surface of the insulating substrate each on either longitudinal end thereof, and a resistive element electrically in contact with said top electrodes, wherein each of said first and second top electrodes has, on its inner side facing to the other, a cutout part and a protruding part protruding with respect to the cutout part, with said cutout part in the first top electrode extending from at least one of two longitudinal sides of the insulating substrate, transversely inwards of the insulating substrate, and with said cutout part in the second top electrode being arranged substantially point-symmetrically to said cutout part in the first top electrode with respect to a center of the insulating substrate, wherein said resistive element has contacting regions each in contact with said first or second top electrode along the protruding part, and non-contacting regions each out of contact with said top electrodes along the cutout part, and wherein said resistive element has a trimming slot including a linear part extending from at least one point on said non-contacting regions along a longitudinal direction of the insulating substrate, wherein each protruding part of said first and second top electrodes is in a shape with two vertices, whereas said resistive element has contacting points in contact with said vertices, wherein said resistive element consists of a rectangular area enclosed by straight lines connecting said contacting points, and an area other than said rectangular area, wherein said area other than the rectangular area, which is out of contact with the first and second top electrodes, is a trimming-slot-forming area.

2. The rectangular chip resistor according to claim 1, wherein said resistive element has a trimming slot including a linear part extending from at least one point on one non-contacting region on a side of the first top electrode along a longitudinal direction of the insulating substrate, and a trimming slot including a linear part extending from at least one point on one non-contacting region on a side of the second top electrode along a longitudinal direction of the insulating substrate.

3. The rectangular chip resistor according to claim 1, wherein at least one trimming slot is in a shape having said linear part extending along a longitudinal direction of the insulating substrate, and a subsequent bend extending from a tip of said linear part, transversely outwards of the insulating substrate.

4. The rectangular chip resistor according to claim 1, wherein said trimming slot has microcracks.

5. The rectangular chip resistor according to claim 1, wherein an angle of one of two opposite pairs of angles of the rectangular area is 70° to 90°.

6. A method for producing a rectangular chip resistor, comprising:

(A) providing a pair of first and second top electrodes on a top surface of an insulating substrate each on either longitudinal end thereof, (B) providing a resistive element in electrical contact with said first and second top electrodes, and (C) forming a trimming slot in the resistive element for adjusting resistance, wherein in said step (A), said first top electrode is formed so as to have, on its inner side facing to said second top electrode, a cutout part extending from at least one of two longitudinal sides of the insulating substrate, transversely inwards of the insulating substrate, and a protruding part protruding with respect to the cutout part, and said second top electrode is formed so as to have, on its inner side facing to said first top electrode, a cutout part arranged substantially point-symmetrically to said cutout part in the first top electrode with respect to a center of the insulating substrate, and a protruding part protruding with respect to the cutout part, wherein in said step (B), said resistive element is provided in a shape having contacting regions each in contact with said first or second top electrode along the protruding part, and at least one non-contacting region for each top electrode out of contact therewith along the cutout part, and wherein in said step (C), each protruding part of said first and second top electrodes is in a shape with two vertices, whereas said resistive element has contacting points in contact with said vertices, wherein said resistive element consists of a rectangular area enclosed by straight lines connecting said contacting points, and an area other than said rectangular area, wherein said area other than the rectangular area, which is out of contact with the first and second top electrodes, is a trimming-slot-forming area, wherein said trimming slot is formed in said trimming-slot-forming area to include a linear part extending from at least one point on the non-contacting regions of the resistive element along a longitudinal direction of the insulating substrate, by laser trimming from said at least one point.

7. The method according to claim 6, wherein in said step (C), wherein at least one trimming slot is formed by laser trimming from said at least one point on the non-contacting regions along a longitudinal direction of the insulating substrate, and then by laser trimming in a direction bent transversely outwards of the insulating substrate.

8. The method according to claim 6, wherein in said step (C), in forming a plurality of trimming slots extending from a plurality of points on the non-contacting regions of the resistive element along a longitudinal direction of the insulating substrate, said trimming slots are formed by laser trimming so as to partly overlap one on another along a trimming direction.

* * * * *